US011873597B2

(12) United States Patent
Kwon et al.

(10) Patent No.: US 11,873,597 B2
(45) Date of Patent: Jan. 16, 2024

(54) LAUNDRY TREATING APPARATUS

(71) Applicant: LG Electronics Inc., Seoul (KR)

(72) Inventors: Yongwoo Kwon, Seoul (KR); Namchul Kim, Seoul (KR); Seunghyun Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 171 days.

(21) Appl. No.: 17/398,636

(22) Filed: Aug. 10, 2021

(65) Prior Publication Data

US 2022/0049400 A1 Feb. 17, 2022

(30) Foreign Application Priority Data

Aug. 11, 2020 (KR) ..... 10-2020-0100316

(51) Int. Cl.

| | |
|---|---|
| ***D06F 34/34*** | (2020.01) |
| ***D06F 23/02*** | (2006.01) |
| ***D06F 39/02*** | (2006.01) |
| ***D06F 39/08*** | (2006.01) |
| ***D06F 39/12*** | (2006.01) |

(52) U.S. Cl.

CPC ..... *D06F 34/34* (2020.02); *D06F 23/025* (2013.01); *D06F 39/028* (2013.01); *D06F 39/081* (2013.01); *D06F 39/12* (2013.01)

(58) Field of Classification Search

CPC ..... D06F 34/34; D06F 23/025; D06F 39/028; D06F 39/081; D06F 39/12; D06F 34/28; D06F 39/02; D06F 34/30; D06F 37/42

See application file for complete search history.

(56) References Cited

FOREIGN PATENT DOCUMENTS

| | | | |
|---|---|---|---|
| CN | 1888234 | 1/2007 | |
| CN | 201351230 | 11/2009 | |
| CN | 204039764 | 12/2014 | |
| CN | 107475998 | 12/2017 | |
| CN | 108505277 | 9/2018 | |
| CN | 109881446 | 6/2019 | |
| EP | 1956133 | 8/2008 | |
| EP | 2837733 | 2/2015 | |
| EP | 2837733 A1 * | 2/2015 | ..... D06F 39/005 |
| JP | 2020-509894 | 4/2020 | |

OTHER PUBLICATIONS

Extended European Search Report in European Appln. No. 21190410.7, dated Nov. 26, 2021, 10 pages.

Office Action in Chinese Appln. No. 202110912183.4, dated Mar. 22, 2023, 15 pages (with English translation).

* cited by examiner

*Primary Examiner* — Michael E Barr
*Assistant Examiner* — Pallavi Chitta
(74) *Attorney, Agent, or Firm* — Fish & Richardson P.C.

(57) ABSTRACT

A laundry treating apparatus includes a cabinet including a first front panel arranged on a front side and a second front panel arranged on the first front panel and operated by a user, a tub disposed inside the cabinet, a drum rotatably disposed inside the tub to provide a space to store laundry, and a panel cover arranged on a front side of the second front panel to protect the second front panel. The panel cover includes a water penetration prevention rib formed on a top surface thereof to prevent water from penetrating into the control part from an outside.

20 Claims, 23 Drawing Sheets

LAUNDRY TREATING APPARATUS

CROSS-REFERENCE TO RELATED APPLICATION

This application claims the benefit of Korean Patent Application No. 10-2020-0100316, filed on Aug. 11, 2020, which is hereby incorporated by reference as if fully set forth herein.

TECHNICAL FIELD

The present disclosure relates to a laundry treating apparatus, and more particularly, a laundry treating apparatus including a control panel including a control part operated by a user, a drawer panel having a detergent storage part for storing detergent in the rear thereof, and a panel cover configured to protect the control panel and the drawer panel.

BACKGROUND

A laundry treating apparatus is an apparatus that removes contaminants from clothes, bedding, etc. (hereinafter referred to as laundry) put into a drum. The laundry treating apparatus may perform operations such as washing, rinsing, dehydration, and drying. The laundry treating apparatuses may be divided into a top loading type apparatus and a front loading type apparatus depending on how the laundry is put into the drum.

The laundry treating apparatus includes a cabinet defining an exterior, a tub accommodated in the cabinet, a drum rotatably mounted inside the tub and configured to receive laundry introduced thereinto, a control panel including a control part operated by a user, and a drawer panel configured to store a detergent therein.

When the drum is rotated by a motor with washing water supplied to the laundry contained in the drum, dirt may be removed from the laundry by friction against the drum and the washing water.

Related document KR 10-2018-0090003A discloses a laundry treating apparatus including a control panel provided over a front panel, a detergent box disposed on one side of the control panel to store a detergent, and a drawer panel or handle panel including a handle provided at the front of the detergent box. According to the laundry treating apparatus disclosed in the document, when the detergent box is fully inserted into the front panel, the control panel and the drawer panel are arranged in the same plane.

Since the control panel includes a control part operated by a user, it is important to prevent water from penetrating into the control panel. In general, a panel cover or window is installed on an outer surface of the control panel to prevent external water from penetrating into the panel, and an instruction input unit for operating the control part is provided on the outer surface of the panel cover. In this configuration, when the panel cover is not closely coupled to the control panel, a user is likely to be injured due to a poor coupling of the window, and also the quality of appearance of the laundry treating apparatus may be deteriorated.

SUMMARY

One of the various objects of the present disclosure is to provide a laundry treating apparatus capable of improving safety and the quality of appearance through close coupling between a control panel and a panel cover.

Another object of the present disclosure is to provide a laundry treating apparatus including a water penetration preventing rib for preventing water from penetrating into a control part operated by a user from the outside.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

According to exemplary embodiments of the present disclosure, a laundry treating apparatus may include: a cabinet including a first front panel provided with a cabinet door allowing laundry to be introduced therethrough, a control panel arranged on one side on the first front panel and provided with a control part operated by a user, a drawer panel arranged on an opposite side on the first front panel and provided in a rear thereof with a detergent storage part configured to store detergent; a tub disposed inside the cabinet; a drum rotatably disposed inside the tub to provide a space to store laundry; and a panel cover including a first cover provided on a front side of the control panel to protect the control panel, and a second cover provided on a front side of the drawer panel to protect the drawer panel. The first cover may be coupled to the control panel by sliding in a vertical direction, and the second cover may be coupled to the drawer panel by sliding in a left-right direction.

According to exemplary embodiments of the present disclosure, a laundry treating apparatus may include: a cabinet including a first front panel arranged on a front side, and a second front panel arranged on the first front panel and provided with a control part operated by a user; a tub disposed inside the cabinet; a drum rotatably disposed inside the tub to provide a space to store laundry; and a panel cover arranged on a front side of the second front panel to protect the second front panel. The panel cover may include a water penetration prevention rib formed on a top surface of the panel cover to prevent water from penetrating into the control part from an outside.

The second front panel may include an upper end protrusion protruding forward of the second front panel, wherein the upper end protrusion of the second front panel may be positioned above the panel cover.

The second front panel may include a control panel including the control part, and the panel cover may include a first cover configured to protect the control panel. The water penetration prevention rib may be formed on a top surface of the first cover.

The control panel may include a front surface and a side surface extending rearward from a side end of the front surface of the control panel, and the first cover may include a front surface to cover the front surface of the control panel, and a side surface to cover the side surface of the control panel. The water penetration prevention rib may be formed on a top surface of the front surface of the first cover and a top surface of the side surface of the first cover.

The control panel further may include a first edge portion connecting the front surface and the side surface of the control panel, the first edge portion having a curved shape, and the first cover further may include a third edge portion configured to cover the first edge portion, the third edge portion having a curved shape.

The first cover may surround front and side surfaces of the control panel together, and the water penetration prevention rib may be formed on an inner side of a top surface of the first cover and contact at least a portion of the control panel.

The upper end protrusion of the second front panel may include a first upper end protrusion formed on an upper portion of the control panel to cover at least a portion of the top surface of the first cover, wherein the first upper end protrusion may include a rib accommodation groove formed on a lower surface of the first upper end protrusion. The water penetration prevention rib may be coupled to the rib accommodation groove.

The water penetration prevention rib is formed on an inner side of the top surface of the first cover, and the rib accommodation groove may be formed on an inner side of the lower surface of the first upper end protrusion facing the inner side of the top surface of the first cover.

The control panel may further include a drawer panel coupling portion arranged in parallel with the control part. The second front panel may further include a drawer panel arranged in parallel with the control part, coupled to the drawer panel coupling portion, and provided in a rear thereof with a detergent storage part configured to store detergent. The panel cover may further include a second cover arranged in parallel with the first cover to protect the drawer panel. The water penetration prevention rib may not be formed on the top surface of the second cover.

The upper end protrusion of the second front panel may further include a second upper end protrusion formed on an upper portion of the drawer panel and arranged in parallel with the first upper end protrusion. The rib accommodation groove may not be formed on the lower surface of the second upper end protrusion.

Each of the second front panel and the panel cover may have a curved surface having a central portion protruding forward, and the water intrusion prevention rib may be formed in a curved shape such that a portion of the water intrusion prevention rib formed on a top surface of the central portion of the panel cover protrudes forward when viewed from above.

The second front panel may include a control panel including the control part and a drawer panel arranged in parallel with the control part, and the panel cover may include a first cover configured to protect the control panel and a second cover configured to protect the drawer panel. The first cover may be coupled to the control panel by sliding along a vertical direction. The second cover may be coupled to the drawer panel by sliding toward the control panel along a lateral direction of the second front panel.

An upper portion of the control part may be provided with a first upper end protrusion protruding compared to a front surface or side surface of the control part, wherein a lower portion of the first upper end protrusion may be provided with a rib accommodation groove to accommodate the water penetration prevention rib. The water penetration prevention rib may be inserted into the rib accommodation groove in the vertical direction.

A portion of the top surface of the first cover positioned on a front side of the water penetration prevention rib may be spaced apart from a portion of a lower surface of the first upper end protrusion positioned on a front side of the rib accommodation groove by a predetermined distance along the vertical direction.

A front surface of the control panel, a front surface of the first cover, a front surface of the drawer panel, and a front surface of the second cover may each have a slope inclined with respect to a top surface of the first front panel.

The water penetration prevention rib and the rib accommodation groove may each have a slope inclined with respect to the top surface of the first front panel.

The control panel further may include a drawer panel coupling portion arranged in parallel with the control part, and the drawer panel may include a front surface and a side surface extending rearward from a side end of the front surface of the drawer panel. The second cover may include a front surface to cover the front surface of the drawer panel, and a side surface to cover the side surface of the drawer panel. The side surface of the second cover may further extend along a thickness direction of the second front panel to cover a side surface of the drawer panel coupling portion.

The drawer panel further may include a second edge portion connecting the front and side surfaces of the drawer panel, the second edge portion having a curved shape, wherein the second cover may surround the front and side surfaces of the drawer panel, the second edge portion, and the side surface of the drawer panel coupling portion together.

As described above, the laundry treating apparatus according to exemplary embodiments of the present disclosure may include a control panel provided with a control part operated by a user, a first cover arranged on a front side of the control panel to protect the control panel, a drawer panel arranged in parallel with the control panel and provided in a rear thereof with a detergent storage part configured to store detergent, and a second cover arranged on a front side of the drawer panel to protect the drawer panel. A water penetration prevention rib having a shape protruding upward from a top surface of the first cover may be formed at the top of the first cover. The water penetration prevention rib may prevent water from penetrating into the control part from the outside.

The first cover may be coupled to the control panel by sliding from bottom to top in the vertical direction for ease of coupling of the water penetration prevention rib, and the second cover may be coupled to the control panel by sliding toward the control panel in a left-right direction so as to be more closely coupled to the side surface of the drawer panel. That is, the first cover and the second cover may slide in different directions to be coupled to the control panel and the drawer panel, respectively.

Accordingly, as the panel cover, which includes the first cover and the second cover, is closely coupled to the second front panel, which includes the control panel and the drawer panel, a poor coupling between the second front panel and the panel cover, may be prevented, and the appearance quality of the laundry treating apparatus may be improved.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Hereinafter, exemplary embodiments of the present disclosure will be described with reference to the drawings. The following detailed description is provided to assist in a comprehensive understanding of the methods, devices, and/or systems described herein. However, this is merely an example and the present disclosure is not limited thereto.

In describing the embodiments of the present disclosure, a detailed description of known technology of the related art will be omitted to avoid obscuring the subject matter of the present disclosure. Terms which will be used below are defined in consideration of the functions of the corresponding elements in the present disclosure. The definitions of the terms may vary depending on intention of a user or an operator, customs, or the like. Therefore, the terms should be defined based on the disclosure throughout the specification. The terminology used in the detailed description is merely intended to describe embodiments of the disclosure and should not be construed as limiting. The singular forms include plural referents unless context clearly dictates otherwise. In this specification, terms such as "includes" or "has" are intended to indicate existence of characteristics, figures, steps, operations, constituents, components, parts thereof, or combinations thereof disclosed in the specification. The terms "includes" or "has" should be understood as not precluding existence or possibility of one or more other characteristics, figures, steps, operations, constituents, components, parts thereof, or combinations thereof.

In describing the components of the embodiments of the present disclosure, various terms such as first, second, A, B, (a), (b), etc., are used solely for the purpose of differentiating one component from another, but the essence, order or sequence of the components are not limited to these terms.

Figure 1:
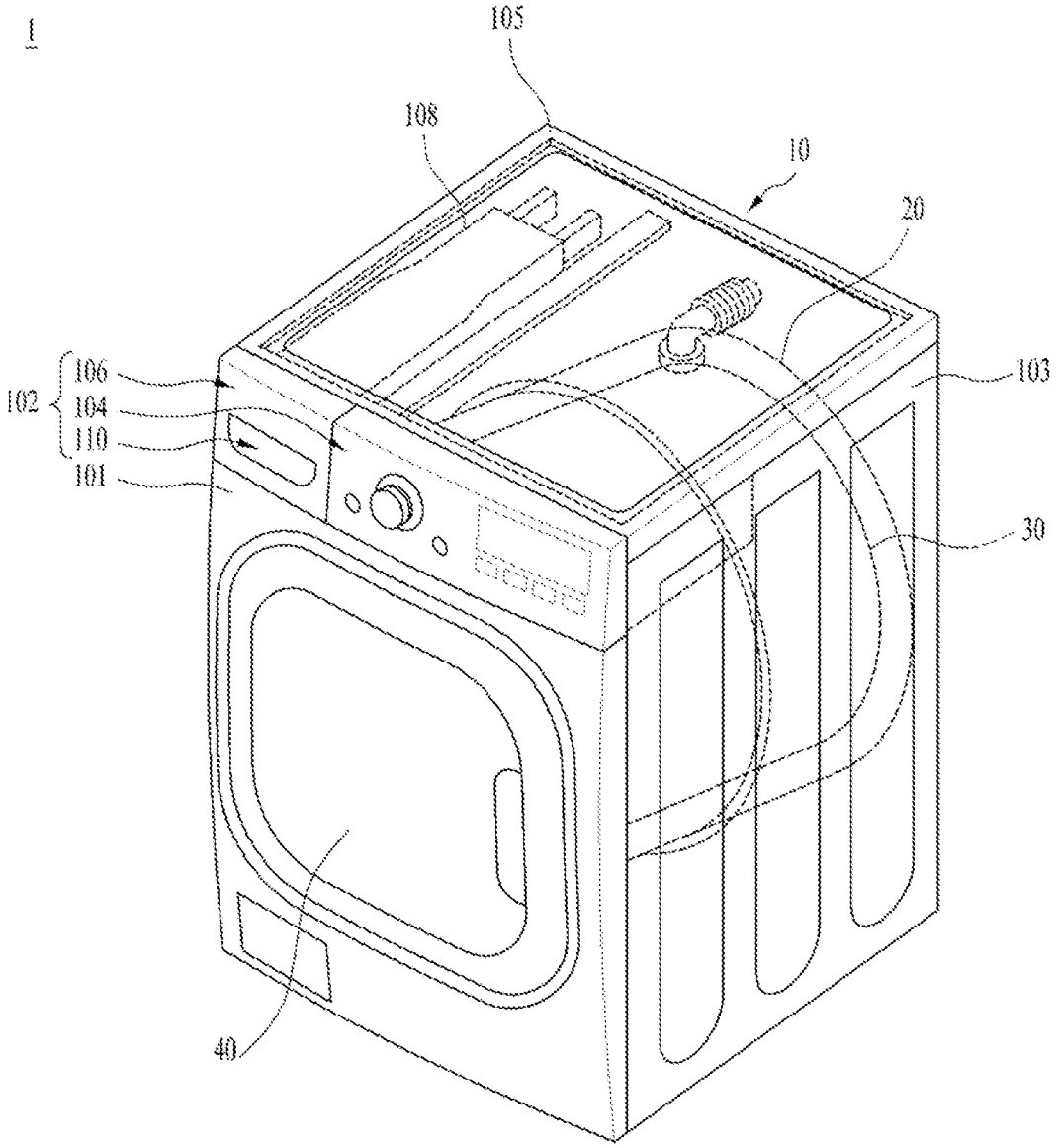
FIG. 1 is a perspective view illustrating a laundry treating apparatus according to an embodiment of the present disclosure.

FIG. 1 is a perspective view illustrating a laundry treating apparatus according to an embodiment of the present disclosure.

Referring to FIG. 1, the laundry treating apparatus 1 may include a cabinet 10 having an opening in a front thereof, a tub 20 arranged in the cabinet 10, and a drum 30 rotatably arranged in the tub 20. The laundry treating apparatus 1 may include a washing machine in which washing, rinsing and dehydration are performed on fabric items inserted into the washing tub, or a dryer in which drying is performed on wet fabric items inserted thereinto.

Specifically, the laundry treating apparatus 1 may include a cabinet 10 defining an exterior, and a first front panel 101 arranged at the front of the cabinet 10 to define a front surface, and a rear panel (not shown) arranged at the rear of the cabinet 10 to define a rear surface. A clothing opening communicating with the drum 30 may be formed in the first front panel 101. The clothing opening may be opened and closed by a cabinet door 40 provided to the first front panel 101. The cabinet door 40 may include a transparent member such as tempered glass allowing the inside of the cabinet 10 or the drum 30 to be visually checked.

In addition, side panels 103 may be provided on both sides of the cabinet 10 in the lateral direction, and an upper panel 105 defining a top surface and a lower panel (not shown) defining a bottom surface may be arranged at the top and bottom of the cabinet 10.

A second front panel 102 provided with a control part operated by a user may be arranged on the first front panel 101. The second front panel 102 may include a control panel 104 including the control part, and a drawer panel 106 arranged in parallel with the control panel 104 in the lateral direction of the second front panel 102 to store detergent. The control part may include various keys configured to control the operation state of the laundry treating apparatus 1 and a display configured to display the operation state of the laundry treating apparatus 1. A detergent supply part 108 to store and supply detergent may be arranged at the rear of the drawer panel 106.

The drawer panel 106 may include a handle part 110 formed by recessing a portion of the front surface of the drawer panel 106 toward the inside of the cabinet 10. The user may use the handle part 110 to control the drawer panel 106. Accordingly, the detergent supply part 108 provided at the rear of the drawer panel 106 may be inserted into or drawn out of the cabinet 10.

The first front panel 101, the second front panel 102, the rear panel, the side panel 103, the upper panel 105 and the lower panel may together define the cabinet 10, and may be coupled to each other.

A tub 20 configured to contain washing water and the drum 30 rotatably arranged in the tub 20 to accommodate laundry may be disposed inside the cabinet 10. Although not shown, in addition to the tub 20 and the drum 30, internal components constituting the laundry treating apparatus 1 may be further arranged inside the cabinet 10. For example, a balancer to compensate for maldistribution caused by rotation may be further provided on one side of the drum 30.

In the laundry treating apparatus 1, clothing that needs to be treated may be introduced into the cabinet 10 through the clothing opening and accommodated in the drum 30, and the treatment operations such as washing and drying may be performed by the laundry treating apparatus 1.

While the clothing opening is illustrated in FIG. 1 as being provided in the first front panel 101 together with the cabinet door 40 according to an embodiment of the present disclosure, the clothing opening is not necessarily limited to the first front panel 101. It may be provided in the side panel 103 or the upper panel 105 together with the cabinet door 40. For example, the laundry treating apparatus 1 may be a front loading type apparatus or a top loading type apparatus.

Figure 2:
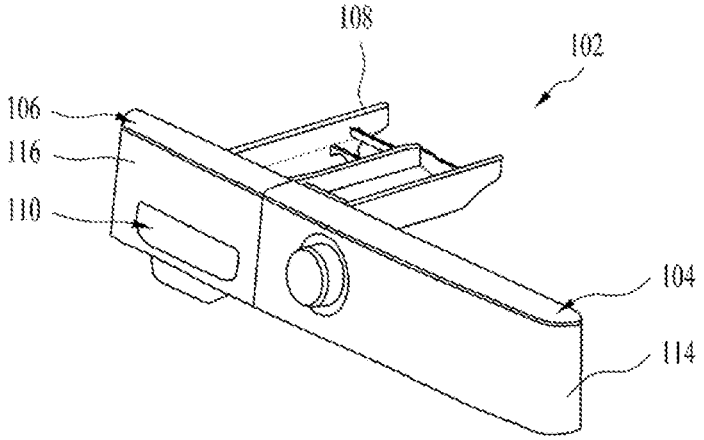
FIGS. 2 and 3 are views illustrating a second front panel according to an embodiment of the present disclosure.
Figure 3:
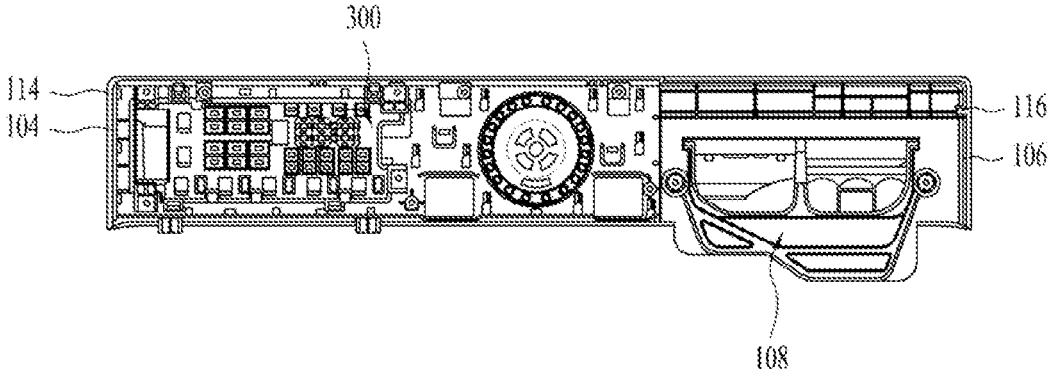

FIGS. 2 and 3 are views illustrating the second front panel according to an embodiment of the present disclosure. More specifically, FIGS. 2 and 3 are a perspective view and a rear view illustrating coupling of the second front panel and a panel cover, respectively.

Referring to FIGS. 2 and 3, in the laundry treating apparatus 1 according to the embodiment of the present disclosure, a panel cover 114, 116 to protect the second front panel 102 may be arranged on the front side of the second front panel 102. In addition, a driving part 300 to drive the control part and a detergent storage part 108 to store detergent may be arranged on the rear side of the second front panel 102. The driving part 300 may include one or more printed circuit boards (PCBs) constituting a circuit.

The second front panel 102 may include the control panel 104 arranged on one side on the first front panel 101 and provided with a control part operated by a user, and the drawer panel 106 arranged on the opposite side on the first front panel 101 and provided in the rear thereof with a detergent storage part 108 configured to store detergent.

The second front panel 102 may include a front surface provided on the front side and both side surfaces extending rearward from both side ends of the front surface. Here, a portion of the front surface of the second front panel 102 may be the front surface of the control panel 104, and the other portion of the front surface of the second front panel 102 may be the front surface of the drawer panel 106. In addition, one of both side surfaces of the second front panel 102 may be the side surface of the control panel 104 located at a side facing away from the drawer panel 106, and the other one of the surfaces of the second front panel 102 may be the side surface of the drawer panel 106 located on a side facing away from the control panel 104.

The panel cover 114, 116 may include a first cover 114 arranged on the front side of the control panel 104 to protect the control panel 104, and a second cover 116 arranged on the front side of the drawer panel 106 to protect the drawer panel 106.

The panel cover 114, 116 may surround the front side surface and both side surfaces of the second front panel 102. The first cover 114 may surround the front and side surfaces of the control panel 104, and the second cover 116 may surround the front and side surfaces of the drawer panel 106.

The panel cover 114, 116 may include a transparent or semi-transparent member such as tempered glass, silicone, or acrylic.

While FIGS. 2 and 3 shows that, when viewed from the front side, the control panel 104 and the first cover 114 are disposed on the right side in the second front panel 102, and the drawer panel 106 and the second cover 116 are disposed on the left side in the second front panel 102, embodiments are not limited thereto. That is, the control panel 104 and the first cover 114 may be disposed on the left side in the second front panel 102, and the drawer panel 106 and the second cover 116 may be disposed on the right side in the second front panel 102.

The length of the control panel 104 extending in a lateral direction of the second front panel 102 (hereinafter referred to as a lateral direction) may be greater than the length of the drawer panel 106 extending in the lateral direction, Accordingly, in the second front panel 102, the proportion of the control panel 104 may be greater than that of the drawer panel 106.

Also, the length of the first cover 114 extending in the lateral direction to protect the control panel 104 may be greater than the length of the second cover 116 extending in the lateral direction to protect the drawer panel 106. Accordingly, in the panel cover 114, 116, the proportion of the first cover 114 may be greater than the proportion of the second cover 116.

In exemplary embodiments, the front surface of the second front panel 102 may be formed in a curved shape with a central portion protruding forward. The central portion of the second front panel 102 may be a part of the control panel 104. In other words, a portion most protruding forward in the front surface of the second front panel 102, that is, the central portion of the front surface of the second front panel 102, may not be arranged at a position where the drawer panel 106 is located in the second front panel 102, but may be arranged at a position where the control panel 104 is disposed. Accordingly, the control panel 104 may include a portion extending between the central portion of the second front panel 102 and the drawer panels 106. In one embodiment, the rear surface of the second front panel 102 opposite to the front surface of the second front panel 102 may be a flat surface.

When the front surface of the second front panel 102 is formed in a curved shape having a central portion protruding forward, each of the front and rear surfaces of the panel cover 114, 116 may also be formed in a corresponding curved shape having a central portion protruding forward. The central portions of the front and rear surfaces of the panel cover 114, 116 may constitute a part of the first cover 114. That is, a portion of the front surface of the panel cover 114, 116 that most protrudes forward, that is, the central portion of the front surface of the panel cover 114, 116 may not be at the position where the second cover 116 is disposed, but may be at the position where the first cover 114 is disposed. In addition, a portion of the rear surface of the panel cover 114, 116 that most protrudes forward, that is, the central portion of the rear surface of the panel cover 114, 116, may not be at the position where the second cover 116 is disposed, but may be located at the position where the first cover 114 is disposed. Accordingly, the first cover 114 may include a portion extending between the central portion of the panel cover 114, 116 and the second cover 116.

In exemplary embodiments, the front surface of the control panel 104, the front surface of the first cover 114 that covers the front surface of the control panel 104, the front surface of the drawer panel 106, and the front surface of the second cover 116 that covers the front surface of the drawer panel 106 may inclined with respect to the top surface of the first front panel 101, rather than being perpendicular to the top surface. In one embodiment, the thickness of the second front panel 102 may gradually decrease from bottom to top.

Figure 4:
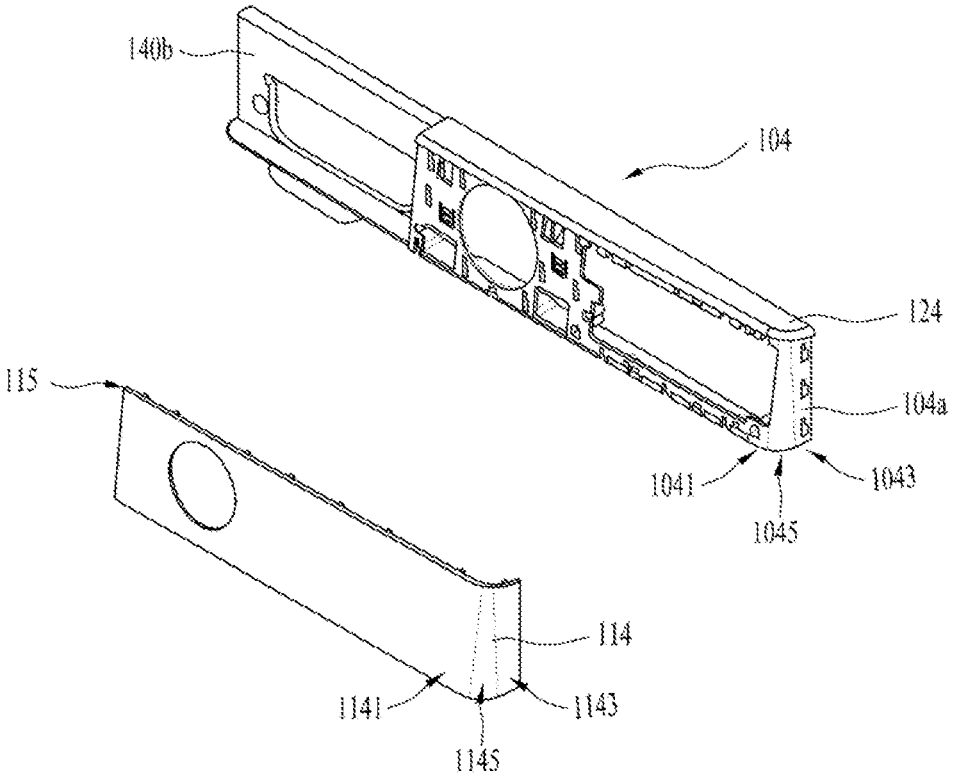
FIGS. 4 and 5 are views illustrating the direction of coupling between a control panel and a first cover according to an embodiment of the present disclosure.
Figure 5:
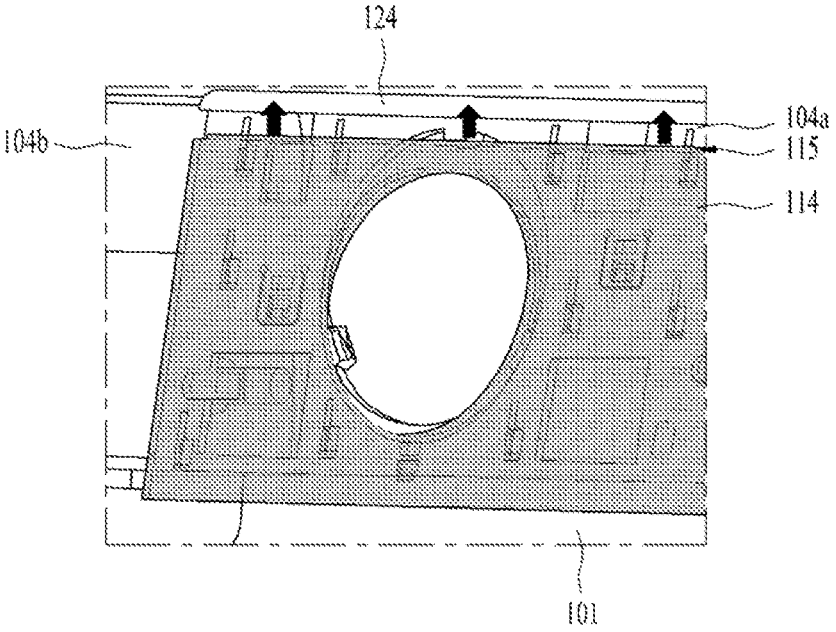

FIGS. 4 and 5 are views illustrating the direction of coupling between a control panel and a first cover according to an embodiment of the present disclosure. More specifically, FIG. 4 is a perspective view illustrating the control panel and the first cover which are not coupled yet, and FIG. 5 is a front view illustrating the direction in which the first cover is coupled to the control panel.

Referring to FIG. 4, the control panel 104 may include a control part 104*a* and a drawer panel coupling portion 104*b* arranged in parallel with the control part 104*a*. The first cover 114 may be coupled to the control panel 104 so as to cover the control part 104*a* included in the control panel 104.

The control part 104*a* may include a front surface 1041, a side surface 1043, and a first edge portion 1045 having a curved shape and configured to connect the front surface 1041 and the side surface 1043 of the control part 104*a*. The first cover 114 may include a front surface 1141, a side surface 1143, and a third edge portion 1145 having a curved shape and configured to connect the front surface 1141 and the side surface 1143 of the first cover 114. Thus, the first cover 114 may cover the control part 104*a* as a whole.

A first upper end protrusion 124 protruding compared to each of the front surface 1041, the side surface 1043, and the first edge portion 1045 of the control part 104*a* may be formed at the top of the control part 104*a*. The first upper end protrusion 124 may cover at least a portion of the top surface of the first cover 114 when the first cover 114 is coupled to the control panel 104.

The drawer panel coupling portion 104*b* may be a portion to which the drawer panel 106, which will described later, is coupled. The drawer panel coupling portion 104*b* may not be covered by the first cover 114. That is, the first cover 114 may surround only the control part 104*a*, and may not surround the drawer panel 106.

Since the front surface of the drawer panel coupling portion 104*b* is covered by the drawer panel 106 later, only the front surface 1041 of the control part 104*a* may serve as the front surface of the control panel 104. Accordingly, the front surface 1041 of the control part 104*a* may be referred to as the front surface 1041 of the control panel 104. In addition, since the first edge portion 1045 and the side surface 1043 of the control part 104*a* continuously extend together with the front surface 1041 of the control part 104*a*, they may be referred to as the first edge portion 1045 and side surface 1043 of the control panel 104.

The first cover 114 may be coupled to the control panel 104 by sliding toward the first upper end protrusion 124 from the bottom to the top, that is, in the vertical direction.

In exemplary embodiments, the front surface 1041 and the side surface 1043 of the control part 104*a*, and the front surface 1141 and the side surface 1143 of the first cover 114 may each have a generally flat surface. In addition, the first edge portion 1045 and the third edge portion 1145 may each have a curved shape. In one embodiment, the front surface 1041 of the control part 104*a* and the front surface 1141 of the first cover 114 have a slope inclined with respect to the top surface of the first front panel 101, respectively.

The panel cover 114, 116 may further include a water penetration prevention rib 115 formed on the top surface thereof to prevent water from penetrating into the control part 104*a* from the outside.

More specifically, the first cover 114 may include the water penetration prevention rib 115 protruding from the top surface thereof in a vertical direction. The water penetration prevention rib 115 may be coupled to the control panel 104 by sliding together with the first cover 114 toward the first upper end protrusion 124 in the vertical direction.

Since the first cover 114 includes the front surface 1141, the side surface 1143, and the third edge portion 1145, the water penetration prevention rib 115 may be formed on each of the front surface 1141, the side surface 1143 and the third edge portion 1145 of the first cover.

In exemplary embodiments, the water penetration prevention rib 115 may extend in the same direction as the extension direction of the curved surface defining the rear surface of the panel cover 114, 116, but may have an extension length less than the extension length of the curved surface defining the rear surface of the panel cover 114, 116. In one embodiment, the water penetration prevention rib 115 may extend along the same direction as the extension direction of the curved surface constituting the rear surface of the first cover 114, and may have an extension length equal to the extension length of the curved surface defining the rear surface of the first cover 114.

In exemplary embodiments, the second front panel 102 and the panel cover 114, 116 may each have a curved surface with a central portion protruding forward. When viewed from above, a portion of the water penetration prevention rib 115 formed on the top surface of the central portion of the panel cover 114, 116 may form a curve protruding forward.

As described above, the central portions of the front and rear surfaces of the first cover 114 and the front surface of the control panel 104 each have a curved surface protruding forward, the control panel 104 includes a portion extending between the central portion of the front panel 102 and the drawer panel 106, and the first cover 114 includes a portion extending between the central portion of the panel cover 114, 116 and the second cover 116. Accordingly, it is difficult for the first cover 114 to slide in the lateral direction to be coupled to the control panel 104. Therefore, the first cover 114 may be coupled to the control panel 104 by sliding in the vertical direction.

In addition, as the first cover 114 includes the water penetration prevention rib 115 which protrudes from the top surface of the first cover 114 in the vertical direction, the water penetration prevention rib makes it more difficult to slide the first cover 114 in the lateral direction to couple the first cover 114 to the control panel 104. Accordingly, the first cover 114 may be coupled to the control panel 104 by sliding in the vertical direction.

Figure 6:
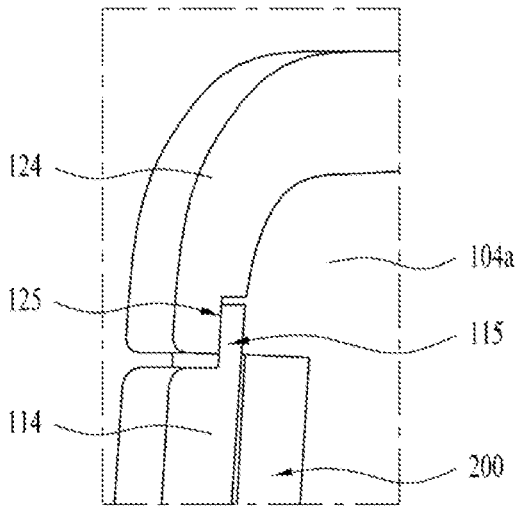
FIG. 6 is a view illustrating a water penetration prevention rib and a rib accommodation groove according to an embodiment of the present disclosure.

FIG. 6 is a view illustrating a water penetration prevention rib and a rib accommodation groove according to an embodiment of the present disclosure. More specifically, FIG. 6 is a cross-sectional view showing the control panel and the first cover coupled to each other.

Referring to FIG. 6, the upper end protrusion of the second front panel 102 may include a rib accommodation groove 125 formed in a lower portion thereof to receive the water penetration preventing rib 115 inserted into the rib accommodation groove 125.

More specifically, the first upper end protrusion 124 may include a rib accommodation groove 125 formed on the lower surface thereof to receive the water penetration prevention rib 115 inserted thereinto. The water penetration prevention rib 115 may be inserted into the rib accommodation groove 125 by sliding together with the first cover 114 toward the first upper end protrusion 124 in the vertical direction.

In exemplary embodiments, the water penetration prevention rib 115 and the rib accommodation groove 125 may extend along the same direction as the extension direction of the curved surface defining the rear surface of the panel cover 114, 116, and may have an extension length less than the extension length of the curved surface defining the rear surface of the panel cover 114, 116. In one embodiment, the water penetration prevention rib 115 and the rib accommodation groove 125 may extend in the same direction as the extension direction of the curved surface defining the rear surface of the first cover 114, and may have an extension length equal to the extension length of the curved surface defining the rear surface of the first cover 114.

In exemplary embodiments, while the water penetration prevention rib 115 stay inserted into the rib accommodation groove 125, the top surface of the first cover 114 except for the portion provided with the water penetration prevention rib 115, that is, the top surface of the first cover 114 positioned on the front side of the water penetration prevention rib 115 may be spaced apart by a predetermined distance from the lower surface of the first upper end protrusion 124 except for the portion provided with the rib accommodation groove 125, that is, the lower surface of the first upper end protrusion 124 positioned on the front side of the rib accommodation groove 125 along the vertical direction.

That is, the water penetration prevention rib 115 may be formed to be higher than the height of the rib accommodation groove 125, such that the water penetration prevention rib 115 may be sufficiently inserted into the rib accommodation groove 125 in the vertical direction. Accordingly, an empty vertical space may not be formed between the water penetration prevention rib 115 and the rib accommodation groove 125. Accordingly, penetration of water into the control part included in the control panel 104 from the outside may be more firmly prevented by the water penetration prevention rib 115.

In exemplary embodiments, the water penetration prevention rib 115 and the rib accommodation groove 125 may each have a slope inclined with respect to the top surface of the first front panel 101. In one embodiment, the water penetration prevention rib 115 and the front surface 1141 of the first cover may have the same inclination with respect to the top surface of the first front panel 101.

That is, when the water penetration prevention rib 115 has a slope perpendicular to the top surface of the first front panel 101, it may be inconvenient to insert the water penetration prevention rib 115 into the rib accommodation groove 125. Accordingly, the water penetration prevention rib 115 may be formed to have a slope inclined with respect to the top surface of the first front panel 101, and the rib accommodation groove 125 may also be formed to have a slope inclined with respect to the top surface of the first front panel 101. Thereby, the water penetration prevention rib 115 may be easily inserted into the rib accommodation groove 125 by sliding along the vertical direction.

In exemplary embodiments, the water penetration prevention rib 115 may be formed on the inner side of the top surface of the first cover 114, and the rib accommodation groove 125 may be formed on the inner side of the lower surface of the first upper end protrusion 124 facing the inner side of the top surface of the first cover 114. Accordingly, the water penetration prevention rib 115 may at least partially contact the front surface 1041, the side surface 1043, and the first edge portion 1045 of the control panel, and therefore penetration of water into the control part may be prevented more effectively.

A driving device accommodating portion 200 may be provided between the control panel 104 and the first cover 114, and a driving part 300 to drive the control part may be arranged in the driving device accommodating portion 200.

Figure 7A:
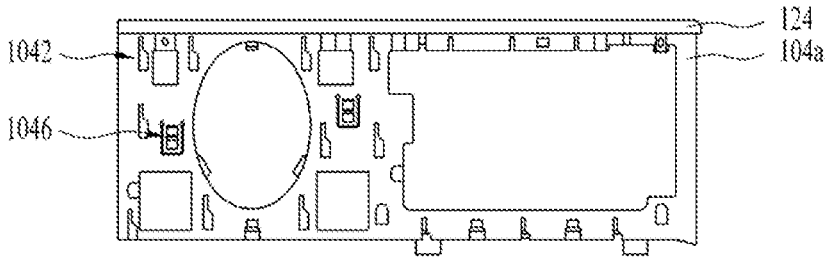
FIGS. 7A to 10 are views illustrating a method of coupling the control panel and the first cover according to an embodiment of the present disclosure.
Figure 7B:
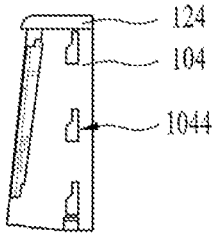
Figure 8:
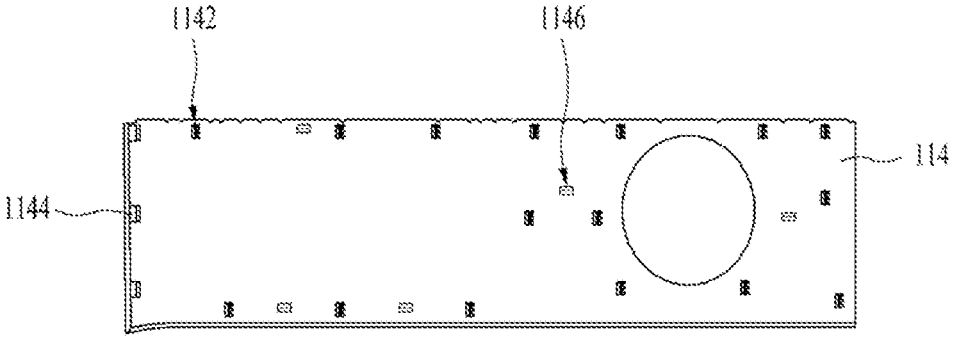
Figure 9A:
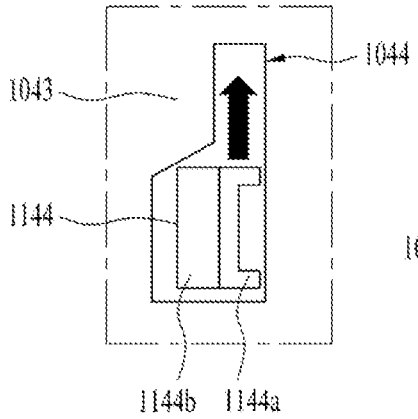
Figure 9B:
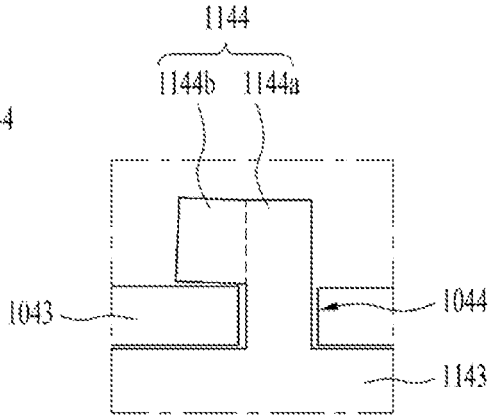
Figure 10:
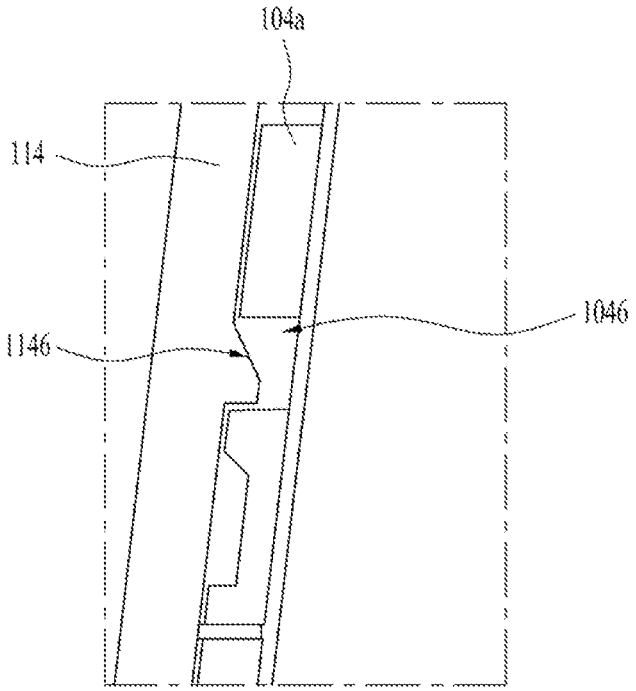

FIGS. 7A to 10 are views illustrating a method of coupling the control panel and the first cover according to an embodiment of the present disclosure. More specifically, FIG. 7A is a front view illustrating the front surface of the control panel, and FIG. 7B is a side view illustrating the side surface of the control panel. FIG. 8 is a rear view illustrating the rear surface of the first cover, and FIGS. 9A and 9B are an enlarged side view and enlarged top view illustrating the method of coupling the control panel and the first cover. FIG. 10 is an enlarged cross-sectional view illustrating the method of coupling the control panel and the first cover.

Referring to FIGS. 7A to 8, a first coupling groove 1042 including a lower portion having a first width and an upper portion having a second width less than the first width may be formed in the front surface 1041 of the control panel 104. Also, a first coupling portion 1142 to be inserted into the first coupling groove 1042 may be formed on the rear surface of the first cover 114. The first coupling portion 1142 may be inserted into the lower portion of the first coupling groove 1042 and then slid in the vertical direction to be coupled to the upper portion of the first coupling groove 1042.

In the first coupling groove 1042, the lower portion of the first coupling groove 1042 may be formed in a shape protruding further toward the side surface 1043 of the control panel along the lateral direction compared to the upper portion of the first coupling groove 1042.

A second coupling groove 1044 including a lower portion having a third width and an upper portion having a fourth width less than the third width may be formed in the side surface 1043 of the control panel 104, and a second coupling portion 1144 to be inserted into the second coupling groove 1044 may be formed on the side surface of the first cover 114. The second coupling portion 1144 may be inserted into the lower portion of the second coupling groove 1044 and then slid in the vertical direction to be coupled to the upper portion of the second coupling groove 1044. In the second coupling groove 1044, the lower portion of the second coupling groove 1044 may be formed in a shape protruding further forward compared to the upper portion of the second coupling groove 1044.

FIG. 9A shows the second coupling portion 1144 inserted into the lower portion of the second coupling groove 1044, and FIG. 9B shows the second coupling portion 1144 coupled to the upper portion of the coupling groove 1044.

Referring to FIGS. 9A and 9B, the second coupling portion 1144 may include a second support 1144*a* protruding from the inner wall of the side surface 1143 of the first cover in the lateral direction, and a second protrusion 1144*b* protruding from the second support 1144*a* in the front-back direction. Here, the second protrusion 1144*b* may be formed to be spaced apart from the inner wall of the side surface 1143 of the first cover.

That is, when the second coupling portion 1144 slides in the vertical direction, the second protrusion 1144*b* may move in the vertical direction in a manner of surrounding a portion of the side surface 1043 of the control panel adjacent to the upper portion of the second coupling groove 1044. The portion of the side surface 1043 of the control panel adjacent to the upper portion of the second coupling groove 1044 may be interposed between the second protrusion 1144*b* and the inner wall of the side surface 1043 of the control panel. Accordingly, the first cover 114 and the control panel 104 may be closely coupled to each other.

Although not shown in the figures, the first coupling groove 1042 and the first coupling portion 1142 may also be coupled in substantially the same manner as the coupling of the second coupling groove 1044 and the second coupling portion 1144. Accordingly, the first cover 114 and the control panel 104 may be closely coupled in the thickness direction (hereinafter referred to as the front-back direction) of the second front panel 102.

Referring to FIG. 10, a third coupling groove 1046 penetrated through the control panel 104 may be further formed in the front surface 1041 of the control panel 104, and a third coupling portion 1146 having a protruding shape may be further formed on the rear surface of the first cover 114. The third coupling portion 1146 may be slid in the vertical direction to be coupled to the third coupling groove 1046. Accordingly, the coupling between the third coupling portion 1146 and the third coupling groove 1046 may prevent the first cover 114 from being separated from the control panel 104 in the vertical direction.

Figure 11:
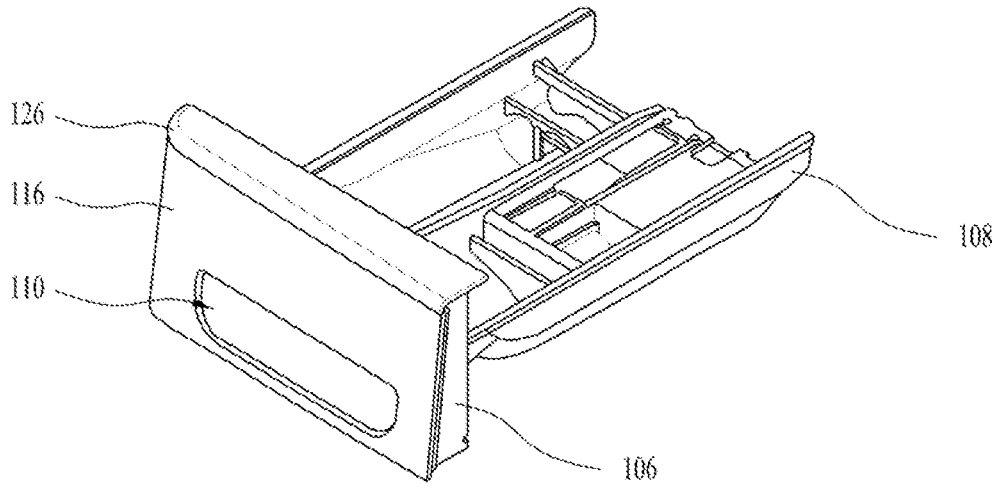
FIGS. 11 and 12 are views illustrating coupling between a drawer panel and a second cover according to an embodiment of the present disclosure.
Figure 12:
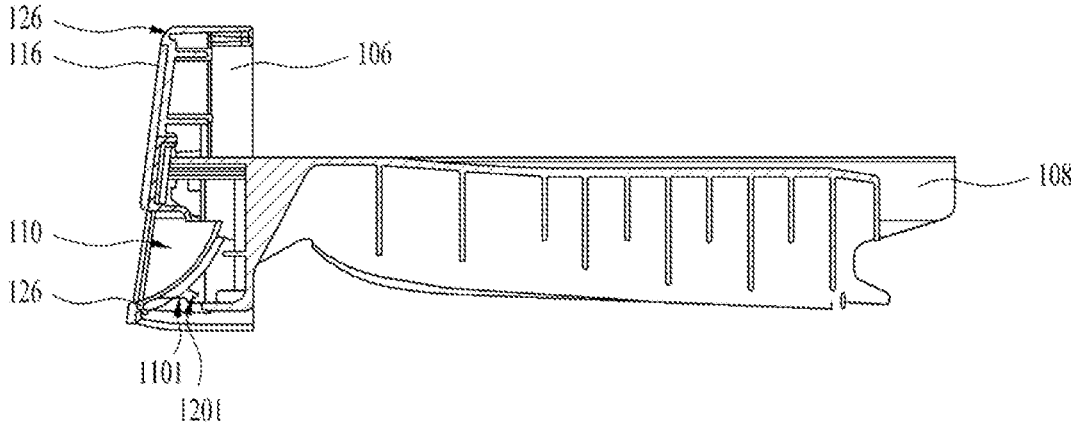
Figure 13:
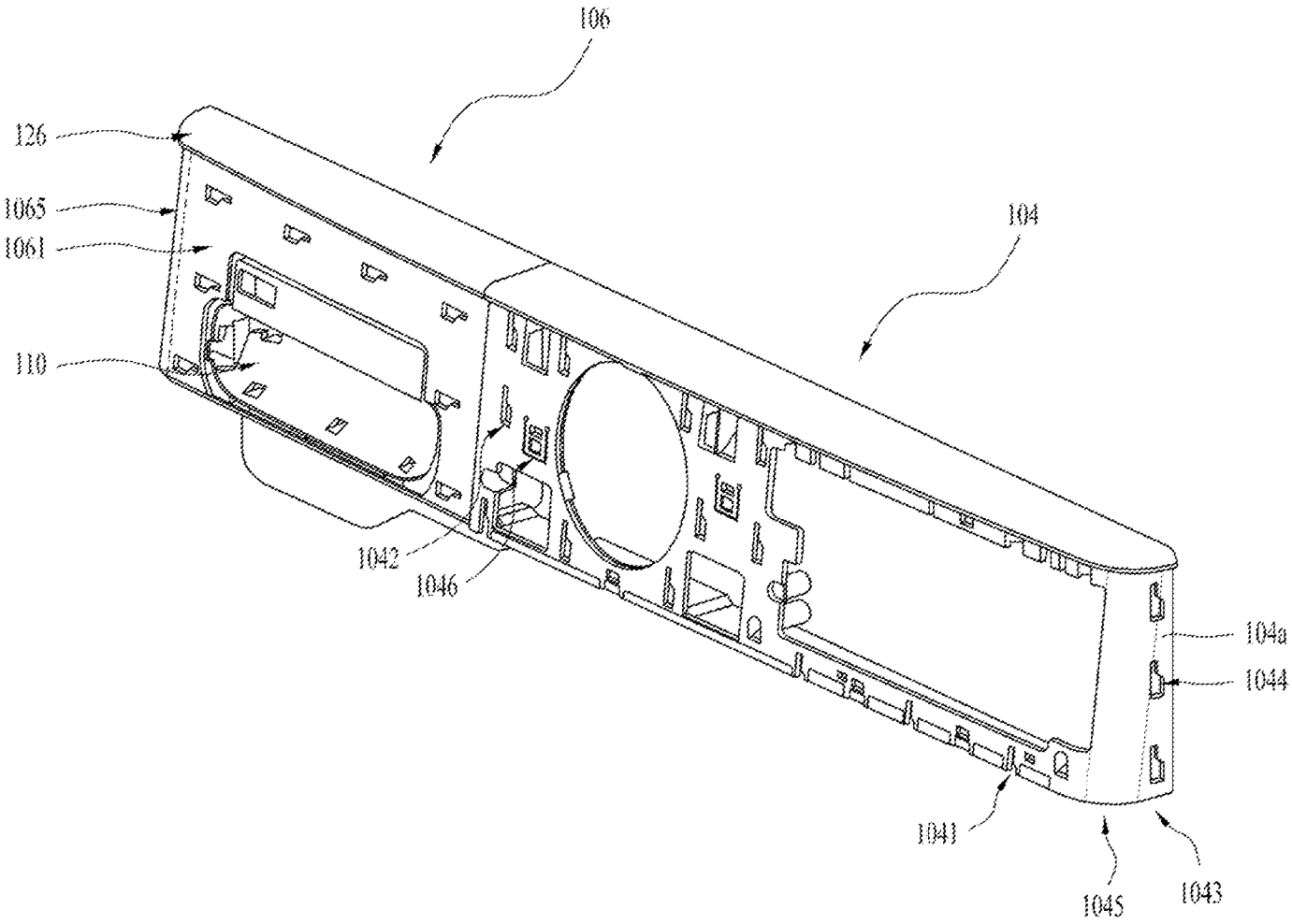
FIGS. 13 to 16 are views illustrating the drawer panel and the control panel coupled to each other according to an embodiment of the present disclosure.
Figure 14:
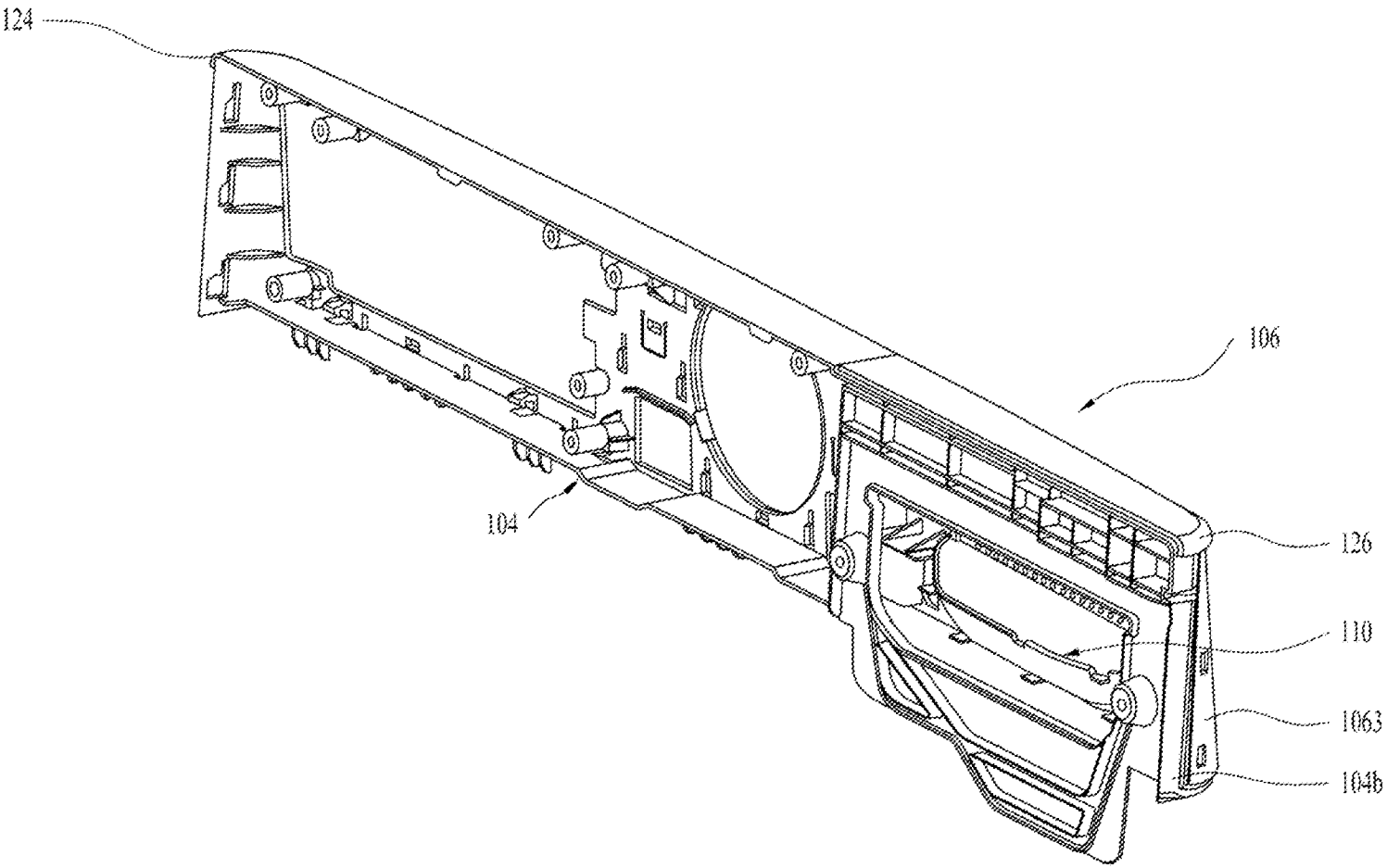
Figure 15:
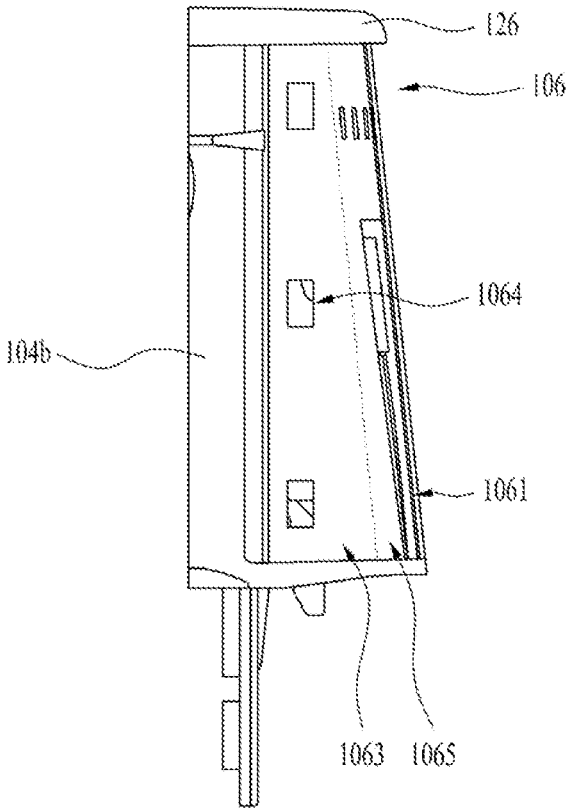

FIGS. 11 and 12 are views illustrating coupling between a drawer panel and a second cover according to an embodiment of the present disclosure.

Referring to FIGS. 11 and 12, the upper end protrusion of the second front panel 102 may further include a second upper end protrusion 126 protruding forward from the top of the drawer panel 106 and arranged parallel to the first upper end protrusion 124 along the lateral direction. The second upper end protrusion 126 may cover the top surface of the second cover 116 when the second cover 116 is coupled to the control panel 106.

The water penetration prevention rib 115 may not be formed on the top surface of the second cover 116, and the rib accommodation groove 125 may not be formed on the lower surface of the second upper end protrusion 126. That is, the water penetration prevention rib 115 may be formed only on the top surface of the first cover 114 except the top surface of the second cover 116, and the rib accommodation groove 125 may be formed only in the lower surface of the first upper end protrusion 124 except the lower surface of the second upper end protrusion 126.

That is, unlike the control panel 104 including the control part operated by the user, the drawer panel 106 does not include the control part. Accordingly, the water penetration prevention rib 115 configured to prevent water from penetrating into the control part from the outside may not be formed on the top surface of the drawer panel 106, and the rib accommodation groove to receive the water penetration prevention rib 115 inserted thereinto may not be formed in the lower surface of the second upper end protrusion 126.

FIGS. 13 to 16 are views illustrating the drawer panel and the control panel coupled to each other according to an embodiment of the present disclosure Referring to FIGS. 13 to 16, the drawer panel 106 may be coupled to a drawer panel coupling portion 104*c* of the control panel 104.

The drawer panel 106 may include a front surface 1061, a side surface 1063, and a second edge portion 1065 connecting the front surface 1061 and the side surface 1063 of the drawer panel 106 and having a curved shape.

In exemplary embodiments, each of the front surface 1061 and the side surface 1063 of the drawer panel and the front surface 1161 and the side surface 1163 of the second cover may be a flat surface as a whole. The second edge portion 1065 and the fourth edge portion 1165 may each have a curved shape. In one embodiment, the front surface 1061 of the drawer panel and the front surface 1161 of the second cover may each have a slope inclined with respect to the top surface of the first front panel 101.

In one embodiment, the front surface 1061 of the drawer panel may be a curved surface that protrudes forward as it extends toward the control panel 104.

The second upper end protrusion 126 may cover the top surface of the drawer panel coupling portion 104*b*, and thus the top surface of the drawer panel coupling portion 104*b* may not be exposed to the outside.

The side surface 1063 of the drawer panel may not cover the side surface of the drawer panel coupling portion 104*b*, and thus the side surface of the drawer panel coupling portion 104*b* may be exposed to the outside. That is, the side surface of the drawer panel coupling portion 104*b* and the side surface 1063 of the drawer panel may be sequentially arranged toward the front side.

Figure 16:
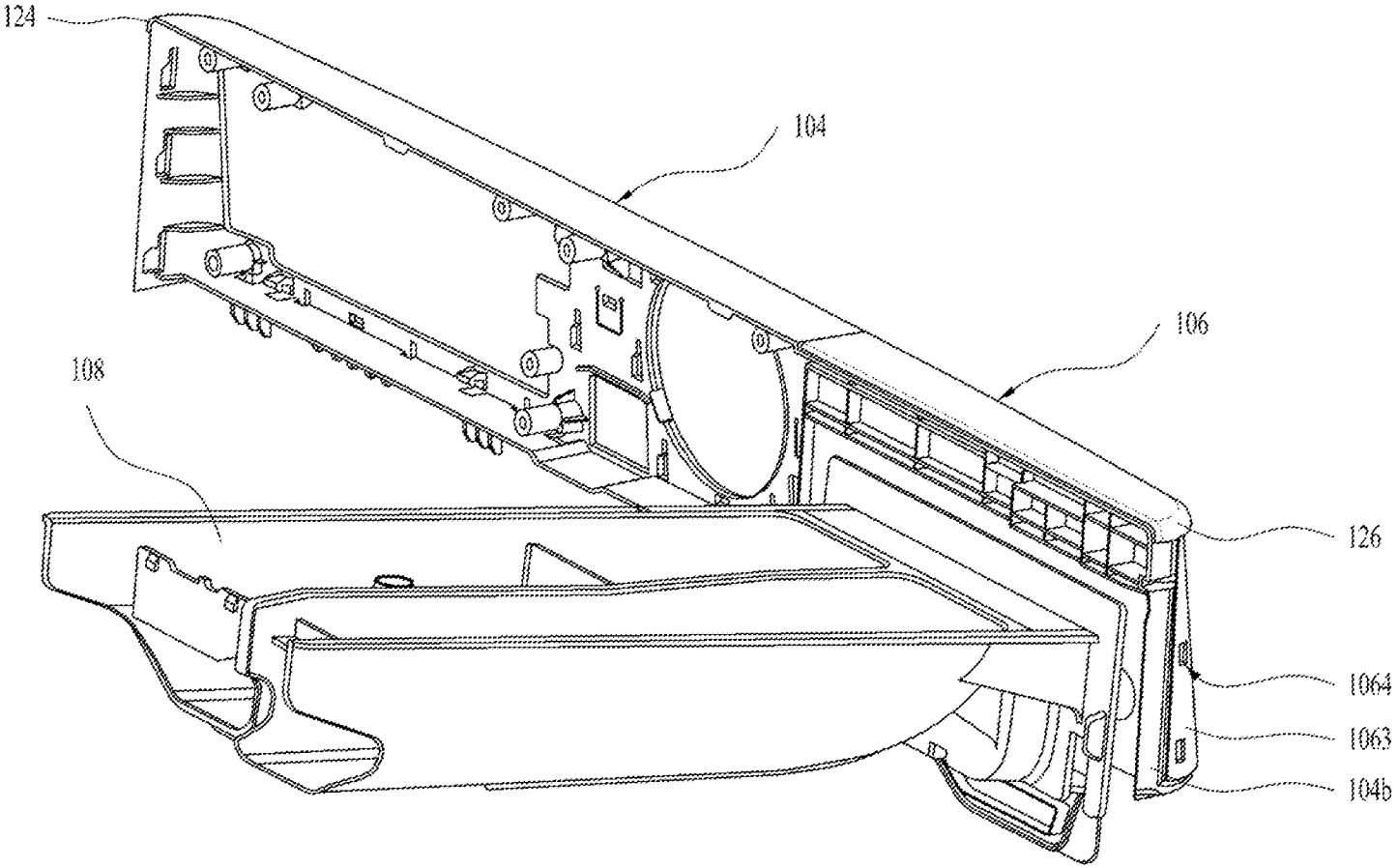

FIG. 16 illustrates that the detergent supply part 108 configured to store and supply detergent is coupled to the rear of the drawer panel 106 through the drawer panel coupling portion 104*b* of the control panel 104

FIGS. 17 to 23 are views illustrating a coupling direction and coupling method of the drawer panel and the second cover according to an embodiment of the present disclosure.

Figure 17:
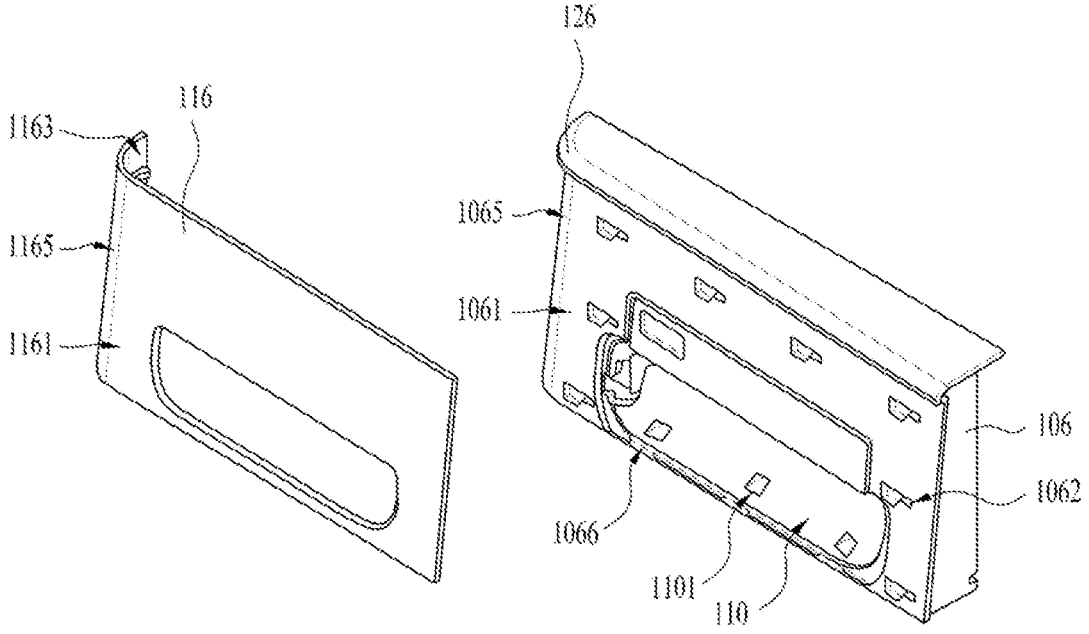
FIGS. 17 to 23 are views illustrating a coupling direction and coupling method of the drawer panel and the second cover according to an embodiment of the present disclosure.

Referring to FIG. 17, the second cover 116 may be coupled to the drawer panel 106 by sliding toward the control panel 104 from, for example, left to right along the lateral direction.

That is, since the central portion of the second front panel 102, which is a portion of the front surface of the second front panel 102 that most protrudes forward, does not constitute a part of the drawer panel 106, it is not difficult to couple the second cover 116 to the drawer panel 106 by sliding the second cover 116 in along the lateral direction. In addition, since the second cover 116 does not include the water penetration prevention rib 115, the second cover 116 does not need to be slid in the vertical direction to be coupled to the drawer panel 104. Accordingly, the second cover 116 may be coupled to the drawer panel 106 by sliding along the lateral direction.

Unlike the control panel 104 fixed to the front of the cabinet 10, the drawer panel 106 should be arranged to allow the detergent supply part 108 provided at the rear to be inserted into or drawn out of the cabinet 10. Accordingly, the second cover 106 to protect the drawer panel 106 needs to be more closely coupled to the side portion of the drawer panel 106. Accordingly, as the second cover 116 slides along the lateral direction and is coupled to the drawer panel 106, the distance between the side portion of the second cover 116 and the side portion of the drawer panel 106 may be further reduced.

The second cover 116 may include a front surface 1161, a side surface 1163, and a fourth edge portion 1165 connecting the front surface 1161 and the side surface 1163 of the second cover 116 and having a curved shape. The front surface 1161, the side surface 1163, and the fourth edge portion 1165 correspond to the front surface 1061, the side 1063, and the second edge portion 1065 of the drawer panel 106. Thus, the second cover 116 may cover the lower panel 106 as a whole.

In exemplary embodiments, the front surface 1061 of the drawer panel, the side surface 1063 of the drawer panel, the front surface 1161 of the second cover, and the side surface 1161 of the second cover may each be flat as a whole, whereas the second edge portion 1065 of the drawer panel and the fourth edge portion 1165 of the second cover may each have a curved shape. In one embodiment, the front surface 1061 of the drawer panel and the front surface 1161 of the second cover may each have a slope inclined with respect to the top surface of the first front panel 101.

In exemplary embodiments, the front surface 1161 and the rear surface of the second cover may each form a curved surface that protrudes forward as it extends toward the first cover 114.

Figure 18:
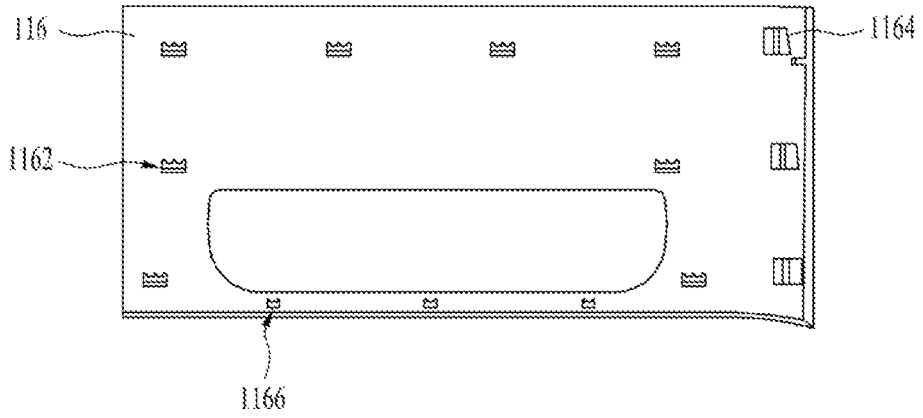
Figure 19B:
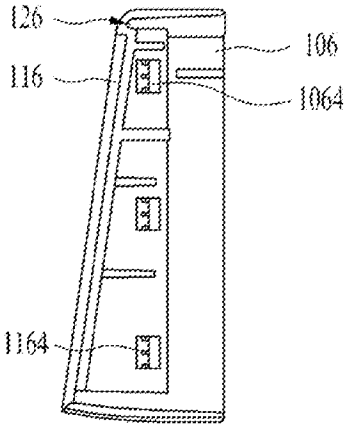

Referring to FIGS. 18 to 19B, a fourth coupling groove 1062 including a first portion having a fifth width and a second portion having a sixth width less than the fifth width may be formed in the front surface 1061 of the drawer panel 106. In addition, a fourth coupling portion 1162 to be inserted into the fourth coupling groove 1062 may be formed on the rear surface of the second cover 116. The fourth coupling portion 1162 may be inserted into the first portion of the fourth coupling groove 1062 and then slid toward the control panel along the lateral direction so as to be coupled to the second portion of the fourth coupling groove 1062. The first portion of the fourth coupling groove 1062 may be positioned on the side facing the control panel 104 in the fourth coupling groove 1062, and the second portion of the fourth coupling groove 1062 may be positioned on the side facing away from the control panel 104 in the fourth coupling groove 1062.

In exemplary embodiments, the fourth coupling groove 1062 may be shaped such that the first portion of the fourth coupling groove 1062 protrudes further downward than the second portion of the fourth coupling groove 1062.

Referring to FIGS. 18 to 20B, the fourth coupling portion 1162 may include a fourth support 1162*a* protruding from the rear side of the front surface 1161 of the second cover in the front-back direction, and a fourth protrusion 1162*b* protruding from the fourth support 1162*a* in the lateral direction. Here, the fourth protrusion 1162*b* may be spaced apart from the rear side of the second cover front surface 1161.

That is, when the fourth coupling portion 1162 slides along the lateral direction, the fourth protrusion 1162*b* may move along the lateral direction in a manner of surrounding a portion of the front surface 1061 of the drawer panel adjacent to the second portion of the fourth coupling groove 1062. The portion of the front surface 1061 of the drawer panel adjacent to the second portion of the fourth coupling groove 1062 may be interposed between the fourth protrusion 1162*b* and the front surface 1161 of the second cover 116. Accordingly, the second cover 116 and the drawer panel 106 may be closely coupled to each other.

Referring to FIGS. 18, 19A, 19B, and 22, a fifth coupling groove 1064 penetrated through the drawer panel 106 may be formed in the side surface 1063 of the drawer panel 106, and a fifth coupling portion 1164 to be inserted into the fifth coupling groove 1064 may be formed on the side surface 116*c* of the second cover 116. The fifth coupling portion 1164 may be coupled to the fifth coupling groove 1064 by moving toward the control panel 104 along the lateral direction. In one embodiment, the fifth coupling portion 1164 and the fifth coupling groove 1064 may be hook-coupled to each other.

Figure 21:
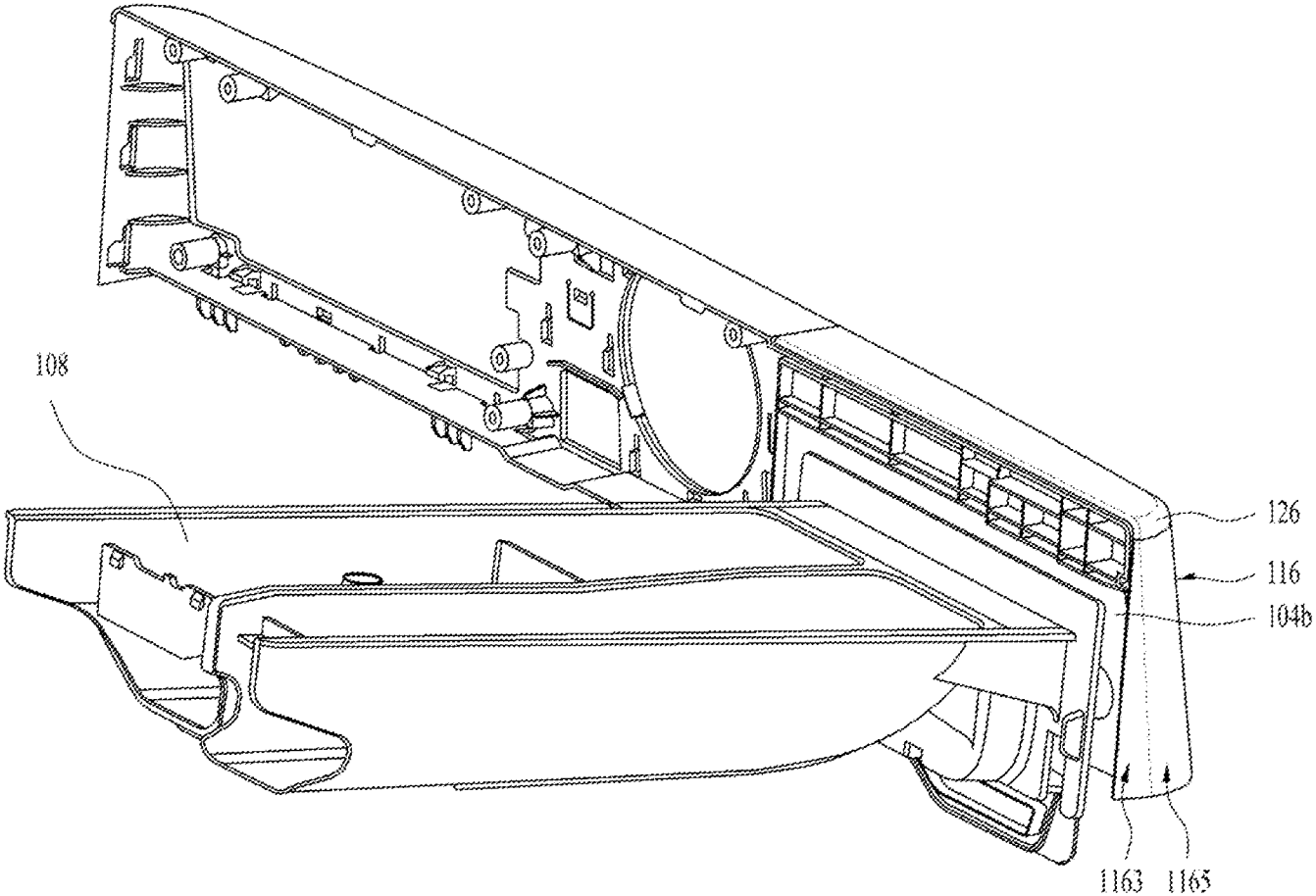
Figure 22:
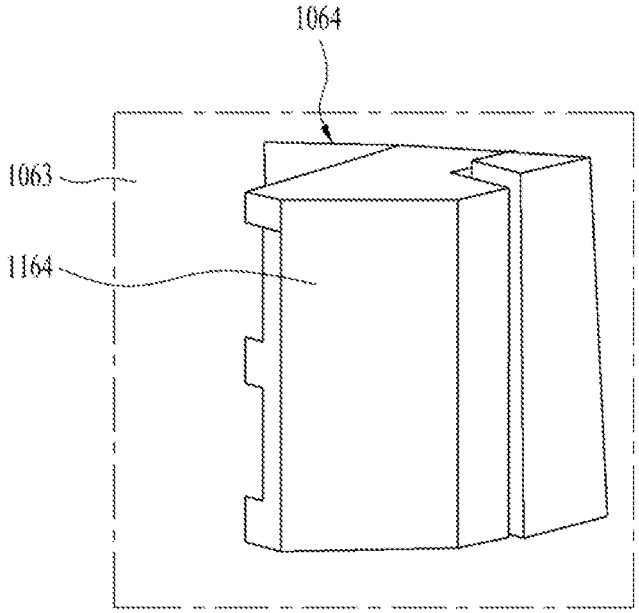

Referring to FIG. 21, the second cover 116 may cover not only the drawer panel 106 but also the drawer panel coupling portion 104*b* of the control panel 104.

In exemplary embodiments, the side surface 1163 of the second cover that covers the side surface 1063 of the drawer panel may be further extended in the front-back direction to cover even the side surface of the drawer panel coupling portion 104*b*.

In exemplary embodiments, an extension length of the second cover side surface 1163 in the front-back direction may be greater than an extension length of the drawer panel side surface 1063 in the front-back direction. In one embodiment, the extension length of the second cover side surface 1163 in the front-back direction may be greater than or equal to the sum of the extension length of the drawer panel side surface 1063 in the front-back direction and the extension length of the side surface of the drawer panel coupling portion 104*b* in the front-back direction.

Figure 23:
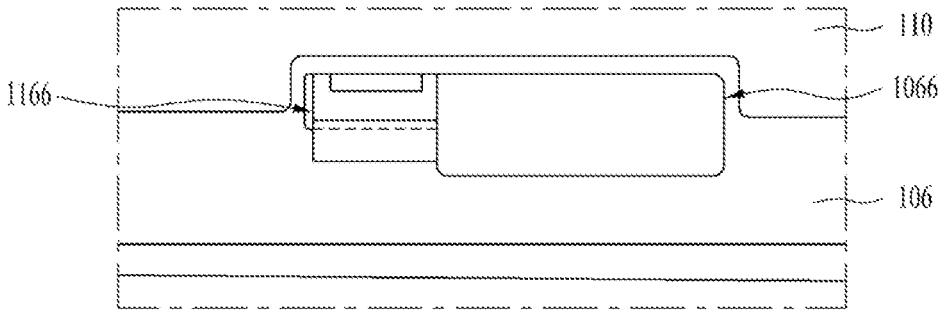

FIG. 23 is a view illustrating a method of coupling the second cover and a handle part according to an embodiment of the present disclosure.

Figure 19A:
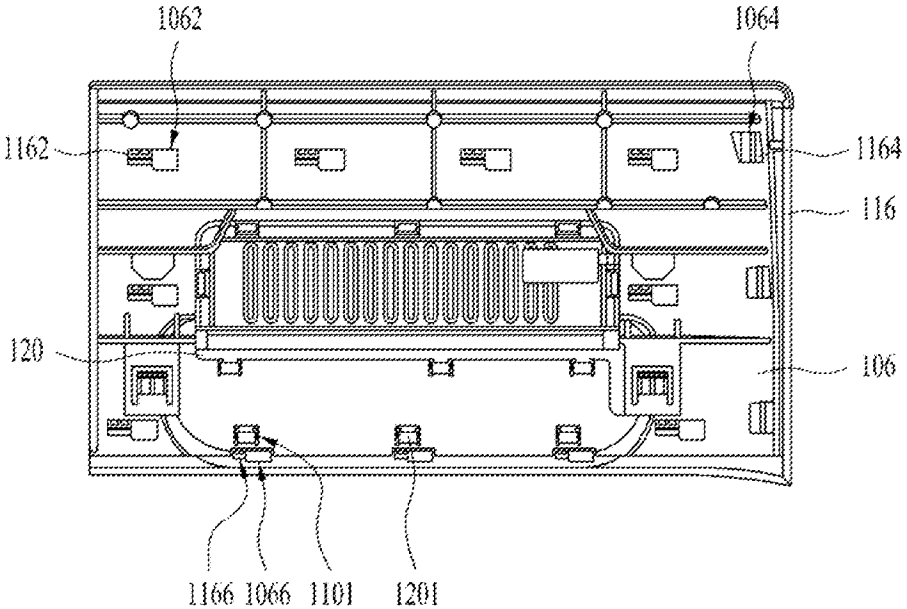
Figure 20A:
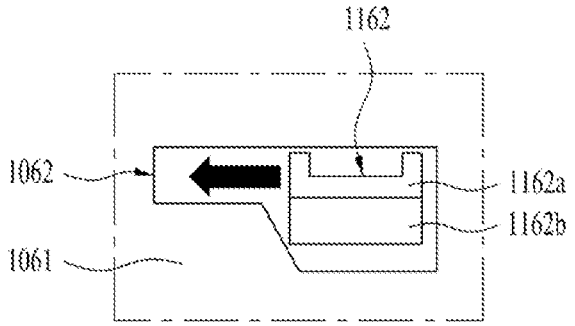
Figure 20B:
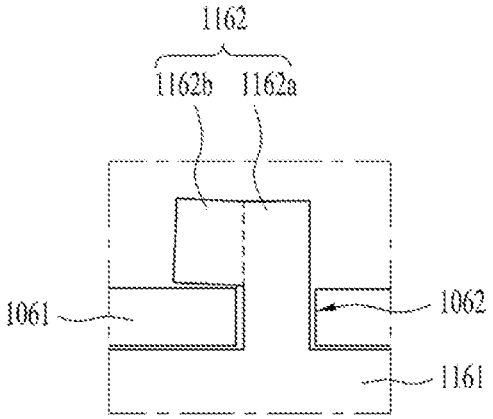

Referring to FIGS. 18, 19A. 19B, and 23, the drawer panel 106 may include a handle part 110 formed by recessing a portion of the front surface 1061 of the drawer panel is drawn toward the inside of the cabinet 10. A handle panel 120 having a shape corresponding to that of the handle part 110 may be coupled to the outer surface of the handle part 110. In exemplary embodiments, the handle panel 120 may be coupled before the second cover 116 is coupled to the drawer panel 106. The second cover 116 may be coupled to the drawer panel 106 after the handle panel 120 is coupled to the handle part 110. In one embodiment, the handle part 110 may include a handle coupling groove 1101, and the handle panel 120 may include a handle coupling portion 1201. The handle coupling portion 1201 may move along the front-back direction to be inserted and coupled to the handle coupling groove 1101.

A sixth coupling groove 1066 penetrated through the drawer panel 106 may be further formed in the lower portion of the handle part 110. In addition, a sixth coupling portion 1166 to be inserted into the sixth coupling groove 1066 may be further formed on the rear surface of the second cover 116. The sixth coupling portion 1166 may move toward the control panel 104 in the lateral direction to be coupled to the sixth coupling groove 1066. That is, the second cover 106 may be additionally coupled to the handle part 110 by sliding along the lateral direction.

As the handle panel 120 is formed separately and coupled to the handle part 110, rather than being integrated with the drawer panel 106, the handle panel 120 and the drawer panel 106 may be made of different materials, thereby preventing possible deterioration in appearance quality.

As described above, the laundry treating apparatus 1 according to exemplary embodiments of the present disclosure may include a control panel 104 provided with a control part operated by a user, a first cover 114 arranged on a front side of the control panel 104 to protect the control panel 104, a drawer panel 106 arranged in parallel with the control panel 104 and provided in a rear thereof with a detergent storage part 108 configured to store detergent, and a second cover arranged on a front side of the drawer panel 106 to protect the drawer panel 106. A water penetration prevention rib 115 having a shape protruding upward from a top surface of the first cover 114 may be formed at the top of the first cover 114. The water penetration prevention rib 115 may prevent water from penetrating into the control part from the outside.

The first cover 114 may be coupled to the control panel 114 by sliding from bottom to top in the vertical direction for ease of coupling of the water penetration prevention rib 115, and the second cover 114 may be coupled to the control panel 114 by sliding toward the control panel 104 in a left-right direction so as to be more closely coupled to the side surface of the drawer panel 106. That is, the first cover 114 and the second cover 116 may slide in different directions to be coupled to the control panel 104 and the drawer panel 106, respectively.

Accordingly, as the panel cover 114, 116, which includes the first cover 114 and the second cover 116, is closely coupled to the second front panel 102, which includes the control panel 104 and the drawer panel 106, a poor coupling between the second front panel 102 and the panel cover 114, 116 may be prevented, and the appearance quality of the laundry treating apparatus 1 may be improved.

It will be apparent to those skilled in the art that various modifications and variations can be made in the present disclosure without departing from the spirit and scope of the disclosure. Thus, it is intended that the present disclosure cover the modifications and variations of this disclosure provided they come within the scope of the appended claims and their equivalents. The scope of the invention should be determined by the appended claims and their legal equivalents thereof.

What is claimed is:

1. A laundry treating apparatus comprising:

a cabinet comprising a first front panel and a second front panel that are arranged at a front side of the cabinet;

a tub disposed inside the cabinet;

a drum rotatably disposed inside the tub and configured to receive laundry; and a panel cover disposed at a front side of the second front panel, wherein the second front panel comprises (i) an upper end protrusion that protrudes faces an upper portion of the panel cover and (ii) a control panel that includes a control part, wherein the panel cover comprises (i) a first cover configured to protect the control panel and (ii) a water penetration prevention rib disposed at an inner side of the upper portion of the panel cover, wherein at least a part of an upper portion of the water penetration prevention rib extends to an inside of the upper end protrusion of the second front panel, and wherein the upper end protrusion defines a rib accommodation groove at an inner side of a lower surface of the upper end protrusion, and the water penetration prevention rib is configured to slide along a vertical direction to be inserted into the rib accommodation groove.

2. The laundry treating apparatus of claim 1, wherein the control panel has a front surface that faces the first cover and a side surface that extends rearward from a side end of the front surface of the control panel, wherein the first cover has:

a first cover front surface that covers the front surface of the control panel, and a first cover side surface that covers the side surface of the control panel, and wherein the water penetration prevention rib is disposed at a top end of the first cover front surface and a top end of the first cover side surface.

3. The laundry treating apparatus of claim 2, wherein the control panel further comprises a first edge portion that connects the front surface of the control panel to the side surface of the control panel, the first edge portion having a curved shape, and wherein the first cover further comprises a first cover edge portion that covers the first edge portion and that has a curved shape.

4. The laundry treating apparatus of claim 3, wherein the water penetration prevention rib extends from each of a top surface of the first cover and an upper portion of the first cover edge portion toward the upper end protrusion of the second front panel.

5. The laundry treating apparatus of claim 1, wherein the first cover surrounds a front surface of the control panel and a side surface of the control panel, and wherein the water penetration prevention rib extends upward from an inner side of a top surface of the first cover and contacts at least a portion of the control panel.

6. The laundry treating apparatus of claim 1, wherein the upper end protrusion of the second front panel comprises a first upper end protrusion that is disposed at an upper portion of the control panel and that covers at least a portion of a top surface of the first cover.

7. The laundry treating apparatus of claim 1, wherein each of the second front panel and the panel cover has a curved surface, and a central portion of the panel cover protrudes forward, and wherein the water penetration prevention rib has a curved shape and includes a portion that is disposed at a top surface of the central portion of the panel cover and that protrudes forward.

8. The laundry treating apparatus of claim 1, wherein the second front panel further comprises a drawer panel arranged in parallel to the control panel, wherein the first cover covers the control panel and is coupled to the control panel by sliding along the vertical direction, and wherein the panel cover further comprises a second cover that covers the drawer panel, the second cover being configured to couple to the drawer panel by sliding toward the control panel along a lateral direction of the second front panel.

9. The laundry treating apparatus of claim 8, wherein the control panel comprises a first upper end protrusion that is disposed at an upper portion of the control panel and that protrudes outward relative to a front surface of the control panel or a side surface of the control panel, and wherein the first upper end protrusion defines the rib accommodation groove at a lower portion thereof.

10. The laundry treating apparatus of claim 9, wherein a portion of a top surface of the first cover is positioned at a front side of the water penetration prevention rib and vertically spaced apart from a lower surface of the first upper end protrusion.

11. The laundry treating apparatus of claim 8, wherein each of a front surface of the control panel, a front surface of the first cover, a front surface of the drawer panel, and a front surface of the second cover is inclined with respect to a top surface of the first front panel.

12. The laundry treating apparatus of claim 9, wherein each of the water penetration prevention rib and the rib accommodation groove extends along a slope inclined with respect to a top surface of the first front panel.

13. The laundry treating apparatus of claim 8, wherein the control panel further comprises a drawer panel coupling portion that is arranged in parallel to the control panel, wherein the drawer panel comprises a front surface and a side surface, the side surface extending rearward from a side end of the front surface of the drawer panel, wherein the second cover comprises a front surface that covers the front surface of the drawer panel and a side surface that covers the side surface of the drawer panel, and wherein the side surface of the second cover extends along a thickness direction of the second front panel and covers a side surface of the drawer panel coupling portion.

14. The laundry treating apparatus of claim 13, wherein the drawer panel further comprises an edge portion that connects the front surface of the drawer panel to the side surface of the drawer panel, the edge portion having a curved shape, and wherein the second cover surrounds the front surface of the drawer panel, the side surface of the drawer panel, the edge portion of the drawer panel, and the side surface of the drawer panel coupling portion.

15. The laundry treating apparatus of claim 8, wherein the control panel comprises:

a first front surface that faces the first cover;

a first side surface that extends rearward from a side end of the first front surface of the control panel; and a first edge portion that connects the first front surface of the control panel to the first side surface of the control panel, the first edge portion having a curved shape, and wherein the first cover further comprises a first cover edge portion that covers the first edge portion and that has a curved shape.

16. The laundry treating apparatus of claim 15, wherein the drawer panel comprises:

a second front surface that faces the second cover;

a second side surface that extends rearward from a side end of the second front surface of the drawer panel; and a second edge portion that connects the second front surface of the drawer panel to the second side surface of the drawer panel, the second edge portion having a curved shape, and wherein the second cover surrounds the second front surface of the drawer panel, the second side surface of the drawer panel, and the second edge portion of the drawer panel.

17. The laundry treating apparatus of claim 8, wherein the first cover and the second cover are arranged laterally adjacent to each other, and wherein a first front surface of the first cover is flush with a second front surface of the second cover.

18. The laundry treating apparatus of claim 1, wherein the second front panel is disposed above the first front panel, and wherein the upper end protrusion of the second front panel extends downward and is in contact with a front surface of the water penetration prevention rib.

19. The laundry treating apparatus of claim 1, wherein the rib accommodation groove covers an upper end of the water penetration prevention rib.

20. The laundry treating apparatus of claim 1, wherein the rib accommodation groove is recessed from the lower surface of the upper end protrusion and extends in the vertical direction, and wherein the rib accommodation groove is curved along (i) a rear surface in contact with a front surface of the water penetration prevention rib and (ii) an upper surface in contact with an upper end of the water penetration prevention rib.

* * * * *